US007467818B2

(12) United States Patent
Young

(10) Patent No.: US 7,467,818 B2
(45) Date of Patent: Dec. 23, 2008

(54) REPAIR AND REINFORCEMENT DEVICE FOR WOODEN DOOR JAMBS

(76) Inventor: Glenn I. Young, 5142 Dermotte La., Richmond, VA (US) 23237

( * ) Notice: Subject to any disclaimer, the term of this patent is extended or adjusted under 35 U.S.C. 154(b) by 16 days.

(21) Appl. No.: 11/382,301

(22) Filed: May 9, 2006

(65) Prior Publication Data

US 2007/0273164 A1 Nov. 29, 2007

(51) Int. Cl.
*E05B 15/02* (2006.01)

(52) U.S. Cl. ..... 292/341.14; 292/DIG. 2; 49/504

(58) Field of Classification Search ..... 292/340, 292/341, 341.11–341.19, DIG. 2; 49/504
See application file for complete search history.

(56) References Cited

U.S. PATENT DOCUMENTS

| | | | | | |
|---|---|---|---|---|---|
| 1,483,333 | A | | 2/1924 | Capeco | |
| 4,126,343 | A | | 11/1978 | Ragland | |
| 4,139,999 | A | | 2/1979 | Allenbaugh | |
| 4,171,836 | A | * | 10/1979 | St. Aubin | 292/341.18 |
| 4,295,299 | A | * | 10/1981 | Nelson | 49/504 |
| 4,547,009 | A | | 10/1985 | Allen | |
| 4,635,399 | A | | 1/1987 | Gehrke et al. | |
| 4,717,185 | A | * | 1/1988 | Hartley | 292/340 |
| 4,763,499 | A | | 8/1988 | Boyle | |
| 4,770,452 | A | | 9/1988 | Petree, Jr. | |
| 4,809,400 | A | * | 3/1989 | Allen | 16/82 |
| 4,854,621 | A | * | 8/1989 | Baldwin | 292/340 |
| 4,858,384 | A | | 8/1989 | Blankenship | |
| 4,993,764 | A | * | 2/1991 | Barker | 292/340 |
| 5,070,650 | A | | 12/1991 | Anderson | |
| 5,076,626 | A | | 12/1991 | Tiddy et al. | |
| 5,241,790 | A | * | 9/1993 | Schimpf | 49/504 |
| D348,202 | S | | 6/1994 | Booth | |
| 5,566,509 | A | * | 10/1996 | Long | 49/462 |
| 5,566,995 | A | | 10/1996 | Jagiela | |
| 5,570,917 | A | | 11/1996 | Cutrer | |
| 5,586,796 | A | | 12/1996 | Fraser | |
| 5,640,808 | A | | 6/1997 | Simeone et al. | |
| 5,737,878 | A | * | 4/1998 | Raulerson et al. | 49/462 |
| 5,752,728 | A | * | 5/1998 | Matouschek | 292/340 |
| 6,418,669 | B1 | | 7/2002 | Suter | |
| 6,598,350 | B1 | | 7/2003 | Suter | |
| 6,691,466 | B2 | | 2/2004 | Childress | |
| 2003/0159361 | A1 | | 8/2003 | Yeremtan | |

* cited by examiner

*Primary Examiner*—Gary Estremsky
(74) *Attorney, Agent, or Firm*—Thomas & Raring, P.C.

(57) ABSTRACT

A door security system serves to substantially improve the reliability of the entire door assembly. The system may consist of up to four or five components. A door jamb shield may be mounted around a door jamb on the side of the door jamb corresponding to the door slab free swinging edge. A door jamb shield may also be mounted on a door jamb on the hinge side of the door jamb. The shield includes a sleeve that wraps on three sides around the door jamb to reinforce and stabilize the door system.

12 Claims, 15 Drawing Sheets

REPAIR AND REINFORCEMENT DEVICE FOR WOODEN DOOR JAMBS

FIELD OF INVENTION

The present invention relates to a door security system, specifically to a mounting system for reinforcement, repair and improved security of door assemblies with wooden jamb miembers. This system relates specific benefit to door jamb reinforcement and repair particularly in the area where the locking devices, door slab and door jamb interface on the free swinging side of the door assembly; and as well it offers similar benefit to the binge attaching area. Furthermore the door security system repairs prior damage to the previously stated areas.

BACKGROUND OF INVENTION

There is an ever increasing need and demand for improving the security and structural integrity of entry doors. This demand is being driven by the repeated occurrences of unauthorized and forced entry through entry doors.

Typically such improvements have focused on pick resistant locks, longer and stronger dead bolts and guard plates. Generally the strengthening and protecting of the locks and bolts have proven to be ill fated attempts at increasing the security of entry doors. The fact is these locks and bolts are mounted and anchor into very soft wooden door slabs and jambs, making their overall effectiveness minimal for security purposes when utilized without overall reinforcement. Traditionally the lock bolt is located in the door slab close to and passing through the doors edge. With this arrangement any significant force applied to the door assembly will cause it to yield and thereby allowing the dead bolt to rip through the door slab. As well the bolt extends into the door jamb through a strike plate that is held in place by short screws. These screws only extend a short distance into the door jamb to secure the strike plate around the receiving opening that is located very close to the inner edge of the jamb. The resulting orientation of the lock bolt, strike and receiving opening is that a thin section of the wooden door jamb is all that remains to resist inward motion of the door slab when the lock bolt is engaged. With this arrangement a person may cause the bolt to rip through the retaining section of the door assembly or jamb merely by applying sufficient force to the door slab itself. Consequently forced entry may be gained without any disturbance or defeat of the security offered by the locking device.

Historically one point of forced entry has been the door jamb specifically in the region where the free swinging edge of the door slab interfaces with the strike plate area of the door jamb. On doors assemblies with deadbolt locks and wooden door slabs or steel door slabs with wooden cores, the wooden jambs particularly in the area where the bolt of the locking mechanism is common to both, the door jamb is considerable inadequate. Consequently prior devices are designed for strengthening and reinforcing this area. These devices did further the structural support of the door assembly, yet overall these devices have considerable shortcomings. Many such devices were frequently aesthetically unacceptable. Their design features also made installation difficult for a traditional layperson. In some cases the visibility of the device made it more easily defeated. Furthermore it should be noted that in many instances such reinforcement devices are sought after the occurrence of forced entry and damage to the door jamb. The presence of this damage on the existing door assembly will prohibit use of the current devices and prohibit proper application of the strike plate.

Yet other prior art consists of a door shield or cover plate that wraps around the door from the interior side through the lock area to the exterior. These U-shaped door shields position on the free swinging edge of the door slab with the side panels overlying and extending along opposite sides of the door slab and are typically secured in position by the locking mechanism. Door shielding devices will offer some degree of protection to the door slab, however due to their construction are limited in security they offer. These devices are either outdated, made of material that is more decorative than strength oriented or are only designed for one lock. As well they offer minimal security when singularly applied.

Still other devices were developed to support and strengthen the door jamb in the area of corresponding to the mounting of the hinges on vertical hung doors. Again these devices are difficult to install in the afforded space of existing doors or require significant detailed finish carpentry to properly complete application.

Though these prior art devices were realized with the best intent, the need still exists for a door security device that focuses on the overall structural inadequacy of doors mounted in and supported by wooden door jambs. The current art fails to produce a system that equally and complementary addresses the conventional points of forced entry and structural vulnerability of vertically hung door assemblies for new and existing structures. Though much of the available prior art will afford greater strength, stability and support of vertically hung hinged doors they nevertheless suffer from a number of disadvantages:

1. The design of the current art does not permit repair of broken door jambs while the door and jamb are still hung in place. Thus the door must be replaced or removed to allow the jamb to be repaired prior to deploying these devices.
2. In many instances the current devices cannot be used on jambs that are damaged,
3. The current devices often have visible parts that are unsightly. This takes away from the overall aesthetics of the door.
4. The current devices that are installed on the backside of the jamb are difficult to hold in place and align while being attached Significant effort is required to ensure the backing plate stays firmly against the jamb.
5. Due to the material thickness of these jamb reinforcement devices or the method of installation several of them require considerable finish carpentry skill to install. These requirements would make installation difficult for a layperson.
6. In some cases the visibility of these devices makes them easier to defeat.
7. Many of the components are ineffective due to their singular nature and individual deployment. Using components separately limits the security they can offer.
8. Construction and materials make current devices unsightly. Their finish can also limit there application due to inability to be painted easily or at all.
9. The devices in current use are made from relatively soft material or materials that limit their application as practical security products by design
10. The hinge and jamb reinforcement and protectors in current use do not wrap around the jamb. Thus their overall effectiveness for securing and reinforcing the door jamb is limited by design.

DISCLOSURE OF INVENTION

As previously disclosed the present invention is for vertically hung hinged entry door assemblies and particularly suited for doors with wooden door jambs. The door assemblies will consist of a four sided wooden door jamb with three hinges on one side to fix the door slab to the door assembly. The assembly components shall also include a door sealing surface that will be situated in the offset surface of the doorjamb and rests against the exterior face of the door slab when in the closed position. Typically there will be a latch bolt lock situated below a dead bolt lock, installed in typical fashion. The doorjamb adjacent to the free swinging edge of the door will have openings positioned so as to allow the plunger portion of the dead bolt to engage a strike plate and be received into the door jamb upon closure and lock activation.

The door security system presented here will serve to substantially improve the reliability of the entire door assembly. This system will consist of up to four to five main components all suitably manufactured of rugged material, preferably steel, and all necessary securing hardware. Securing hardware will depend upon the door application and will be sized to pass through the doorjamb immediately surrounding the door and penetrate a sufficient depth into the rough frame of the main structure. It can be incorporated into the manufacturing process of door assemblies, applied cooperatively to new assemblies or installed on previously hung doors assemblies as functions of the overall system benefit. The latter application can be done by the average layperson with basic hand tools and minimal carpentry experience. Thus significant features of the present invention include allowing for application of the system on previously installed door assemblies and the repairing of damaged assemblies while originally placed, in simple and uncomplicated fashion. The lack of complexity is achieved by the thin three sided wrapping construction of the components, which allows them to easily slide onto position in the applicable areas.

Installation is accomplished by removing the interior door jamb decorative trim molding and cutting or removing the fasteners. This will include removing at least two screws from each hinge to be modified. Install the system components in their corresponding locations and verify the frame is still square. Secure the finished frame to the rough frame with the proper hardware while at the same time securing all system components. Once installed the jamb portions of the system are totally concealed on a closed door that has been properly hung and finished in normal fashion.

With this system, as previously stated, the components can work together to ensure greater strength, stability and support of vertically hung hinged doors. The components that can be combined to make up this system and their function will follow:

1. The door jamb shielding component corresponding to the door slab free swinging edge and coinciding door jamb will be an elongated section of about 16-24 gauge steel sheet metal that is shaped to form a slide on sleeve. It serves to wrap around the door jamb from the facing surface of the door jamb adjacent the free swinging edge of the door slab, around to the interior edge of the door jamb and finally extending along the backside of the door jamb from the interior to the exterior edge. It mounts with the common center section of the sleeve positioned to abut the interior edge of the door jamb and the side panels extend parallel and in close proximity to the door jamb on both sides towards the exterior edge. In the region of the free swinging edge of the door slab and bolt receiving holes of the doorjamb there will be holes in the sleeve to accommodate upper and lower lock bolts. Typically this arrangement will consist of a dead bolt lock oriented above a latch bolt lock. The suitably sized dead bolt lock when manipulated will pass through a first side panel of the sleeve, proceed through the original wooden door jamb, and finally the second side panel of the sleeve. The length of the jamb shield and its the wrapping feature serve to spread any force applied to the door jamb while transferring such load to the door assembly surrounding structure, thereby preventing the splitting of the door jamb. After installation of the doorjamb component, on a typical door assembly, only a minor portion of the jamb member is left exposed above and below the device. Notably this limits the force applied to the door jamb in the unprotected areas and ensures that this force will be of shear in nature. The shear forces are then being applied to the entire cross section of the door jamb in this region instead of the minimal strike plate area of the door jamb. This wrapping feature of the sleeve is a major factor in the uniqueness of this component and the present system of invention. The technology allows the door jamb to be wrapped and once secured with screws the rigidity of the jamb is uncommonly increased. There are at least two versions of this component. A standard version allows for typical lock spacing between the dead bolt and latch bolt. Furthermore a universal application accommodates various lock spacing between the previously mentioned traditional locking mechanisms. The door jamb shield has considerations for new manufactured door assemblies and may be incorporated into the door jamb prior to application of the door assembly weather seal at the factory.
2. The door shielding component is an elongated section of about 16-24 gauge steel sheet metal that is generally U-shaped. It serves to wrap around tie free swinging edge of the door slab in the region corresponding to the lock bolts exiting the door. It mounts with the bottom of the "U" on the free swinging edge of the door slab and the elongated side panels extending, in close proximity, along the interior and exterior faces of the door slab, towards the hinge side of the door. There are two openings in the bottom of the "U" positioned to allow the lock bolt mechanisms to operate without interference. The bolts of the tipper and lower locks, when manipulated accordingly, will pass through the door shield component and into the facing surface of the jamb shield component before continuing as detailed in the jamb component description. Two more holes with coinciding orientation to the holes in the bottom of the "U" will pass through door shield component perpendicular to the aforementioned holes. These holes will serve as the lock mounting space. The primary function of the door shield component as applied to the present invention is to prevent force on the lock bolts from splitting the free swinging edge of the door slab. It subsequently serves to prevent tampering with the locking mechanism. Finally this component can be effective in preventing foreign objects from being forced between the door slab free swing edge and the door jamb interface by creating a much closer tolerance in this region. There are at least two versions of this component. A standard version allows for typical lock spacing between the dead bolt and latch bolt. Furthermore a universal application accommodates various lock spacing between the previously mentioned traditional locking mechanisms. The door shielding component may have considerations for new manufactured door assemblies and may be incorporated into the frame prior to installation of the door assembly weather seal at the factory.

3. The hinge side jamb shield is an elongated section of about 16-24 gauge steel sheet metal that is also shaped to form a slide on sleeve. It serves to wrap around the door jamb from the facing surface of the doorjamb adjacent the fixed edge the door slab, around to the interior edge of the door jamb and finally extending along the backside of the door jamb from the interior to the exterior edge. Mounting with the common center section of the sleeve positioned to abut the interior edge of the door jamb and the side panels extending parallel and in close proximity to the door jamb on both sides towards the exterior edge. The leading edge of the facing surface portion will come to rest underneath the weather sealing component of the door jamb. This wrapping of the sleeve is a major factor in the uniqueness of this component as well. The present component allows the door jamb to be wrapped in steel along three sides in the area of the hinge assembly and once secured with suitable screws the rigidity of the hinge assembly mounting area of the door jamb is greatly benefited with improved ability to resist force applied against the jamb. There will be a substantially rectangular cutout in the side panel of the hinge side jamb shield to allow for positioning around the hinge assembly. The cutout will be situated so as to be generally centered on the shield allowing substantially equal portions of the side panel to extend above and below the mounted hinge assembly as fixed to the door jamb member. There will typically be at least two of these devices required per system to be fitted to the upper most and lower most hinge assemblies. As a variation a third, an optional, hinge side jamb shield can be applied to the area of a central hinge assembly, if desired. Units installed on new manufactured doors will be incorporated into the flame prior to installation of the door seal at the factory. The primary function of the "Hinge Shield" is to prevent forced entry by defeating of the conventional hinges and mounting hardware of vertically hung hinged steel doors with wooden frames. Secondly, this component will stabilize the door in the event of attempted forced entry on the lock side of the entry way. Research has shown that alter continuous abuse the hinge side doorjamb can fail. If this failure occurs the resulting door assembly instability creates the opportunity for the dead bolt plunger to easily disengage from the door jamb member and forcibly gain access. Once this occurs the entire door must be removed and extensively repaired or replaced.

4. The mounting hardware for each alternative component of the present invention will consist of appropriately sized screws. These screws should be sized to allow a minimum 1 inch penetration into the rough wood frame of an entry way. When mounting into masonry structures, comparable screws will be required. The mounting hardware component of the present invention be will suitable for this application and ensure that the door jamb portion of the door assembly is substantially secured to the rough frame of the surrounding structure, further assuring proper deployment of the system. As well the mounting hardware of the featured invention will need to be of a sort suited to inhibiting weather related deteriorating and corrosion.

SUMMARY

It is an object of the present invention to overcome the foregoing drawbacks and shortcomings of the current state of art with door security assemblies that focus on the overall structural inadequacy of doors mounted in and supported by wooden door jambs. The present system can be used alone or in combination to equally and complimentarily address the conventional points of forced entry and structural vulnerability of vertically hung hinged doors for new and existing structures by utilizing wrapping technology. Component parts of the system are generally obscured from view by design. The present invention affords greater strength, stability and support to vertically hung hinged doors that has not been heretofore achieved, in such a manner. As well the object of the present invention is to provide a structurally sound means of repair for previously damaged door assemblies. After installation, the component parts alone or in combination cooperate to substantially benefit and enhance the structural integrity of entry door assemblies.

DETAILED DESCRIPTION OF THE PREFERRED EMBODIMENT

Figure 1A:
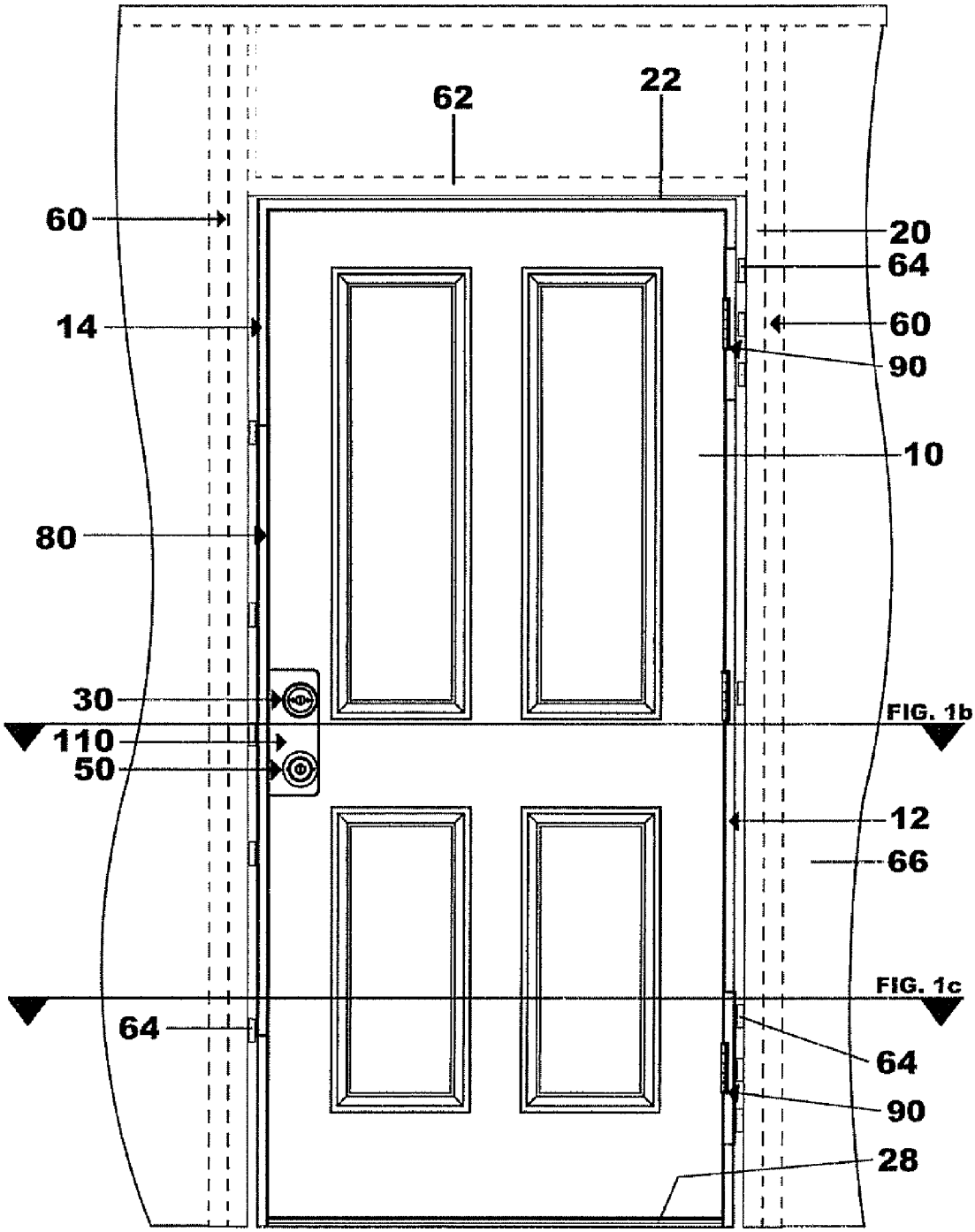
FIG. 1*a* is a front elevation view of an entry door assembly incorporating shield components described herein.
Figure 1B:
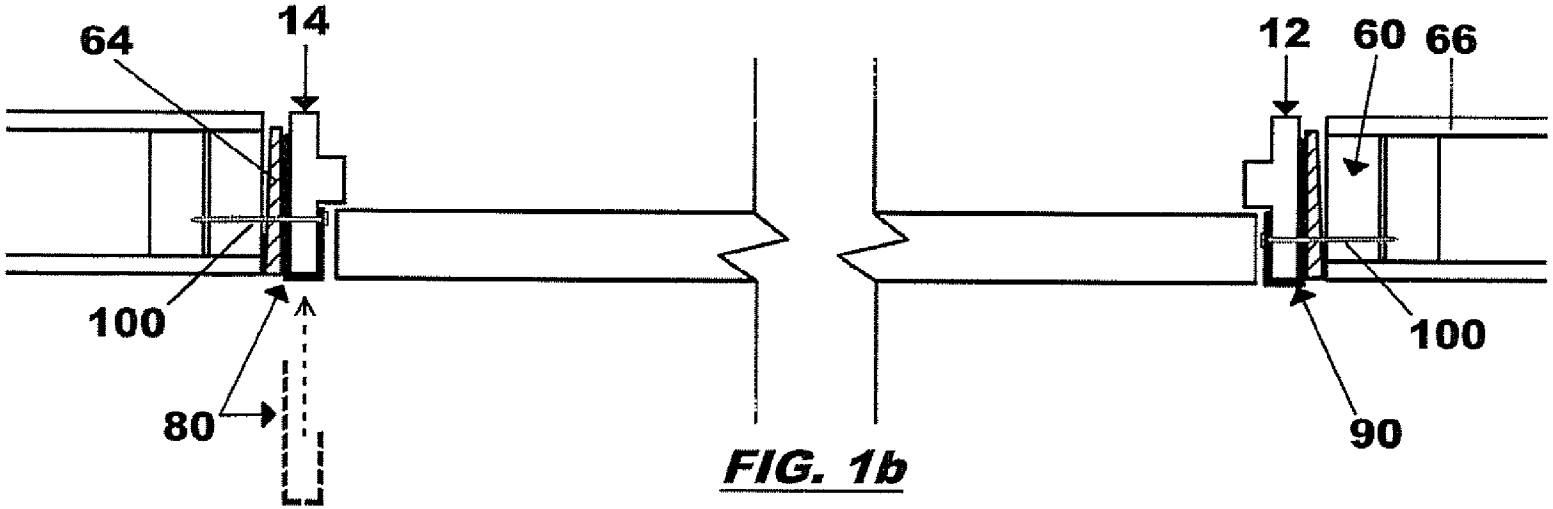
FIGS. 1*b* and 1*c* are top, cross-sectional views of the door shown in FIG. 1*a* taken along lines FIG. 1*b* and FIG. 1*c* respectively.
Figure 1C:
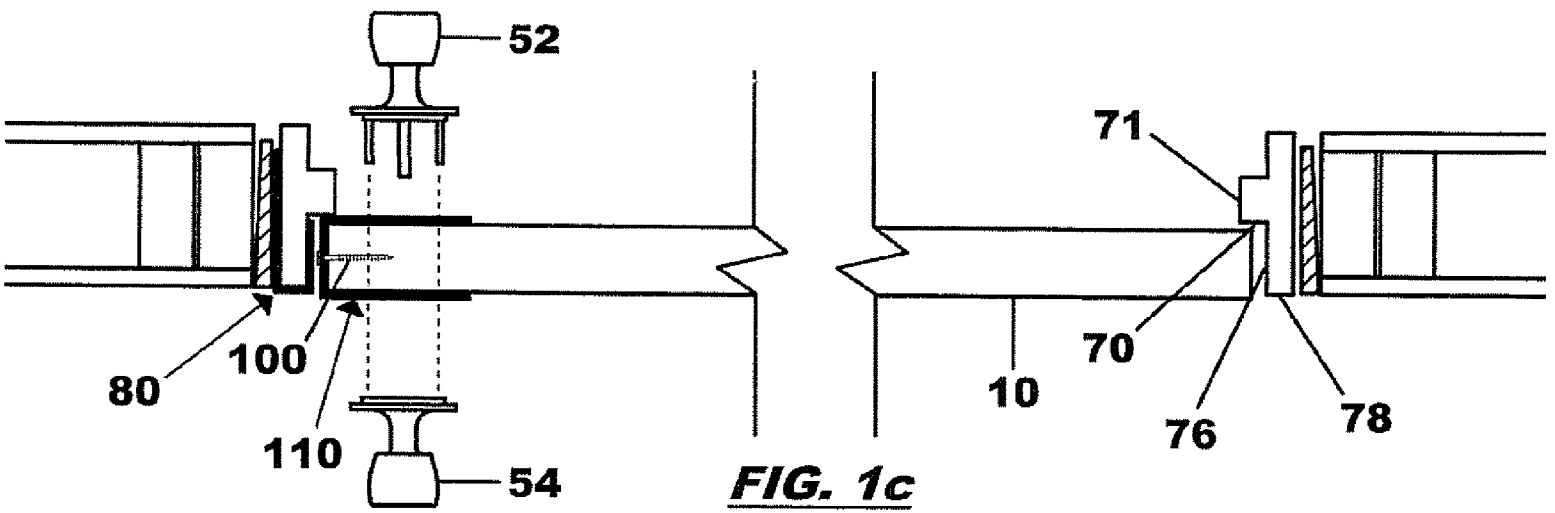
Figure 2:
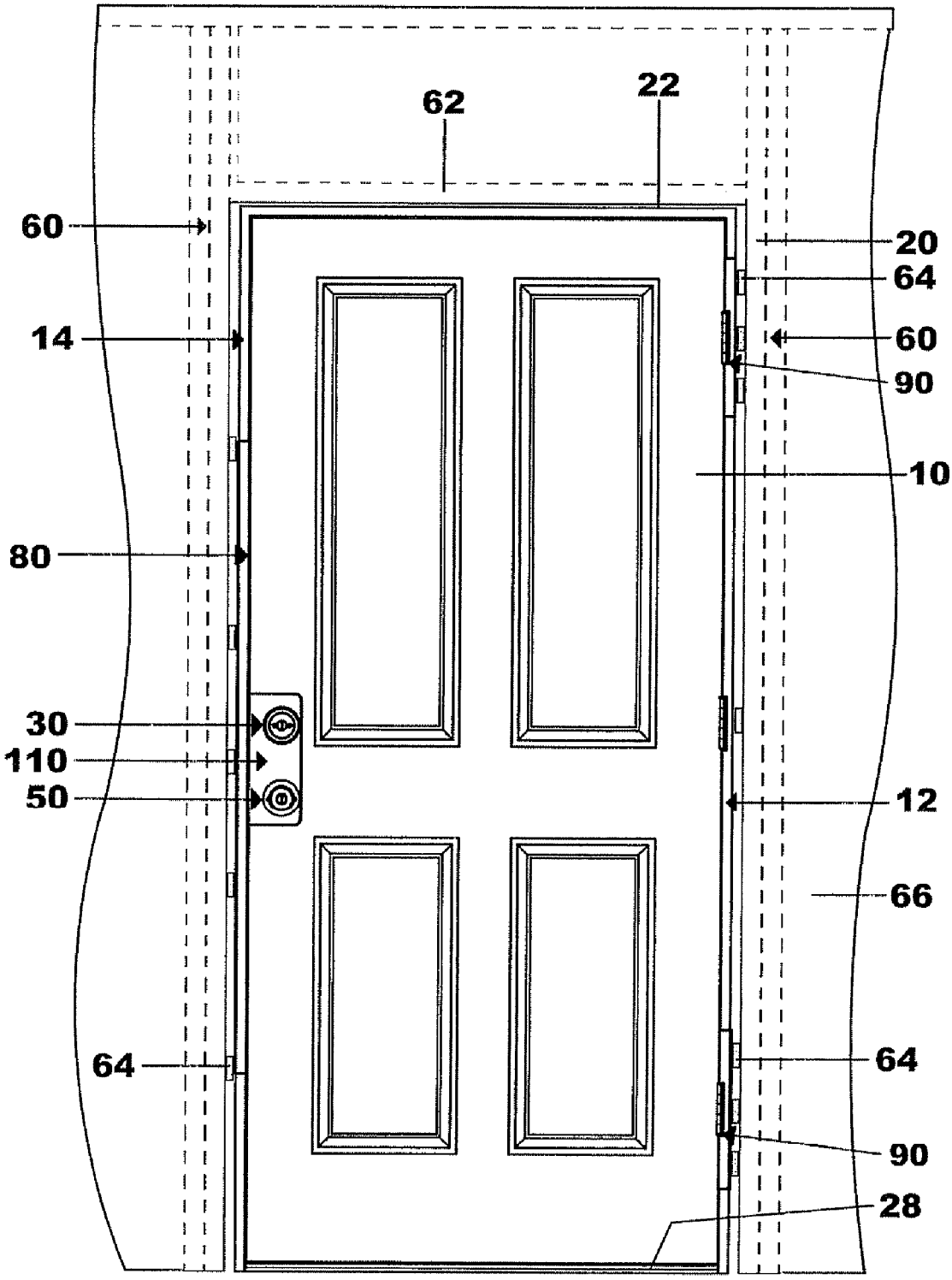
FIG. 2 is a front elevation view of an entry door assembly without any trim molding mounted around the doorway.
Figure 3A:
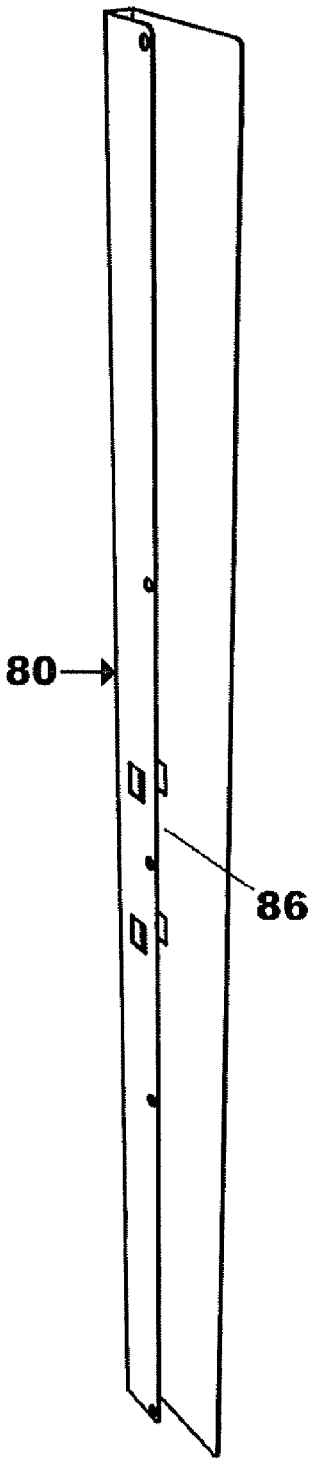
FIGS. 3*a-c* are front elevation, perspective, and top views of a door jamb shield for use on the free swinging door edge of an entry door assembly.
Figure 3B:
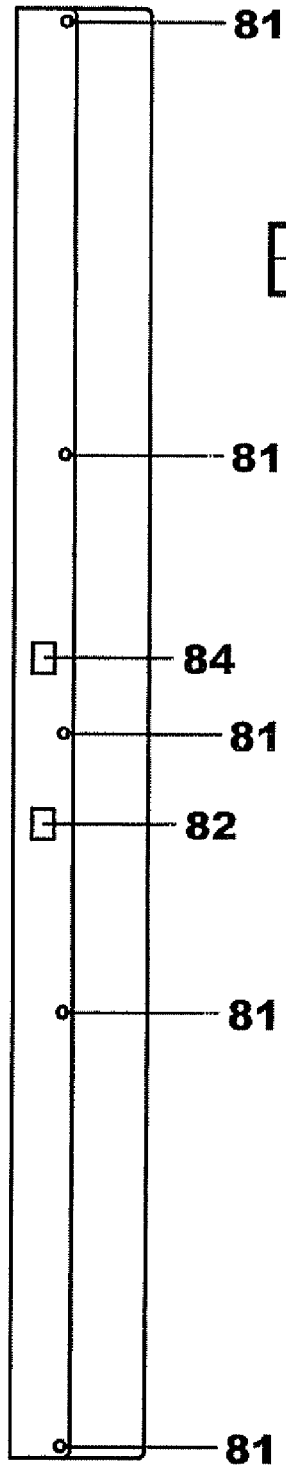
Figure 3C:
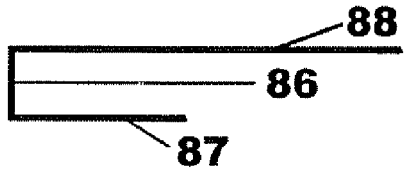
Figure 4A:
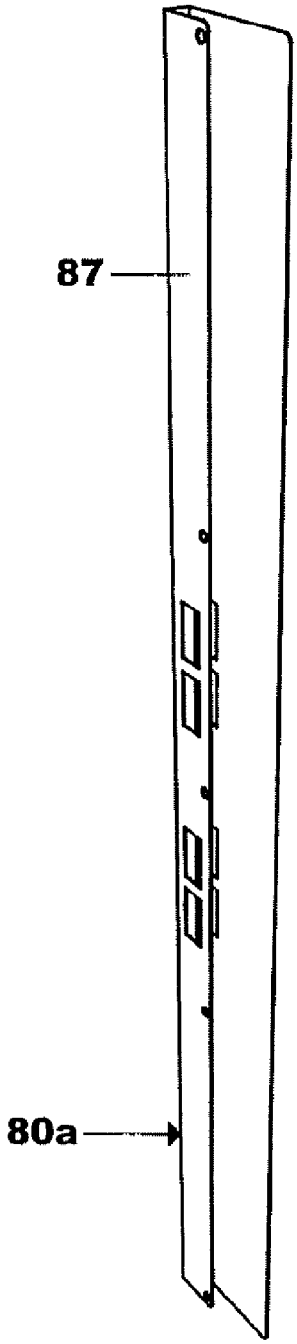
FIGS. 4*a-c* are alternative embodiments of a front elevation, perspective, and top views of a door jamb shield for use on the free swinging door edge of an entry door assembly.
Figure 4B:
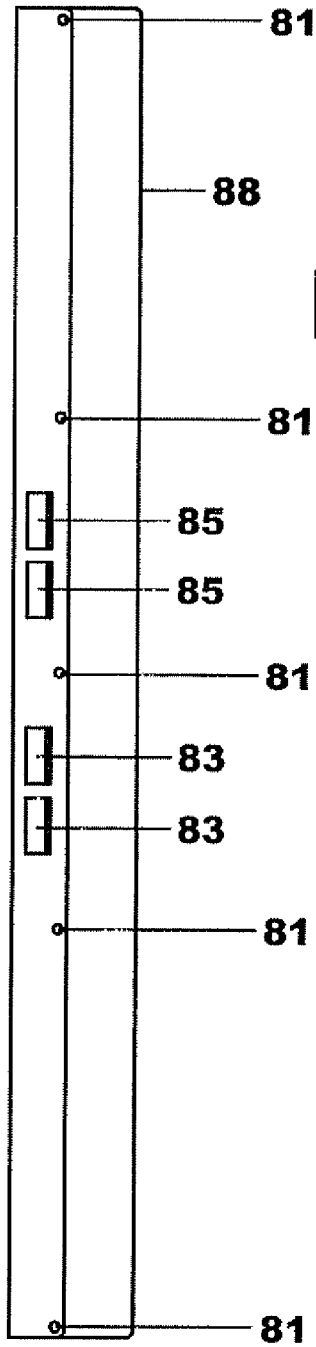
Figure 4C:
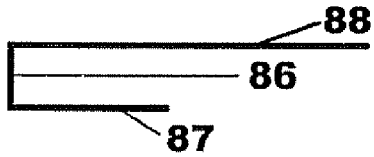
Figure 5A:
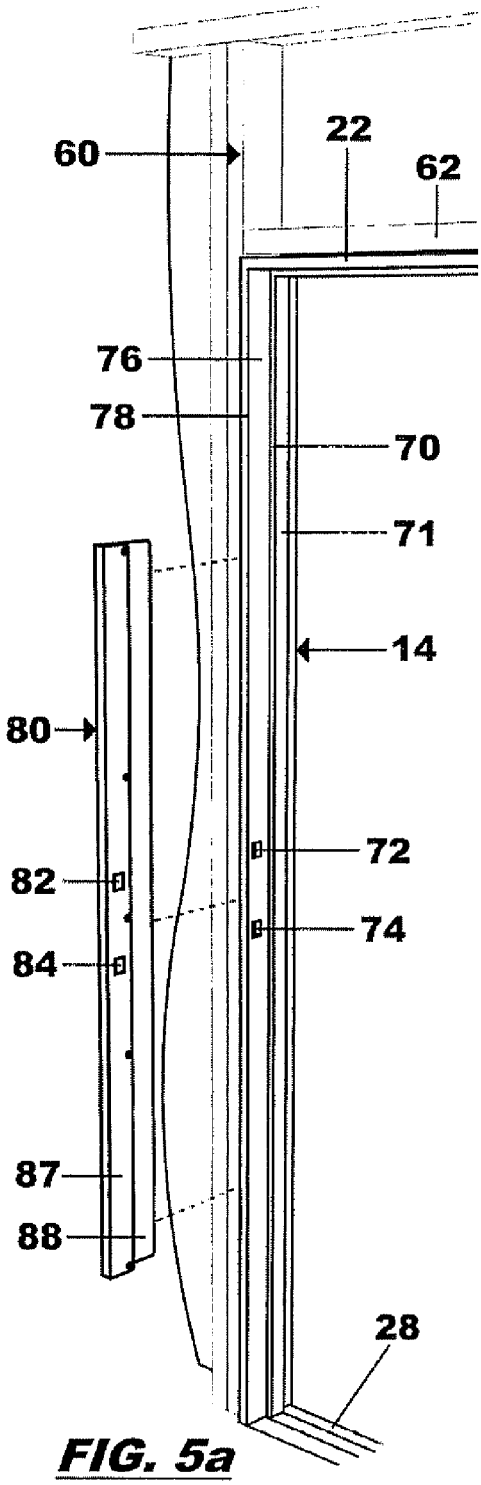
FIGS. 5*a* and 5*b* are perspective views of a portion of a door jamb and door jamb shield corresponding to the free swinging door edge of an entry door assembly.
Figure 5B:
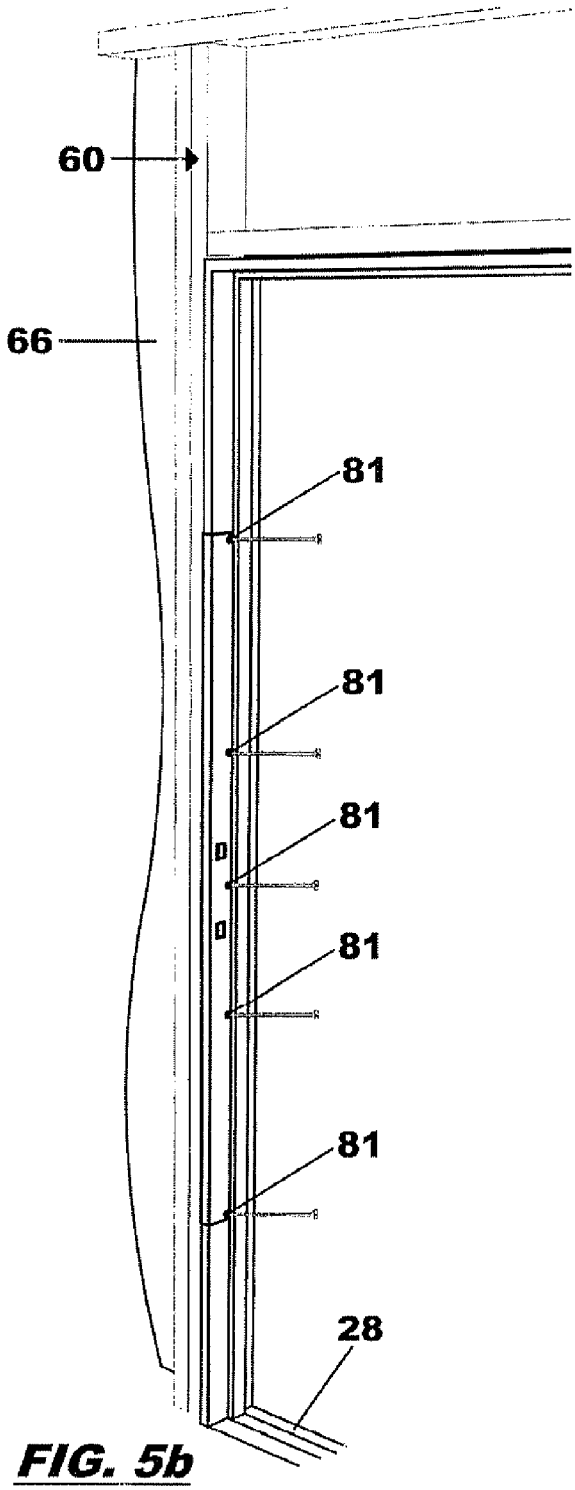
Figure 6A:
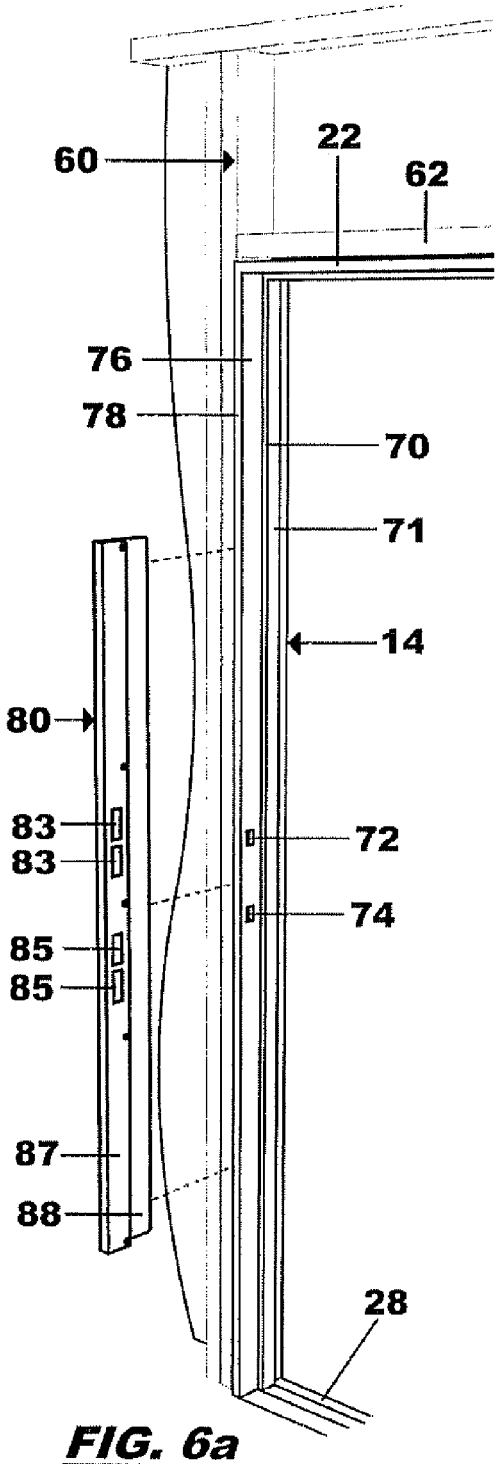
FIGS. 6*a* and 6*b* are alternative embodiments of perspective views of a portion of a door jamb and door jamb shield corresponding to the free swinging door edge of an entry door assembly.
Figure 6B:
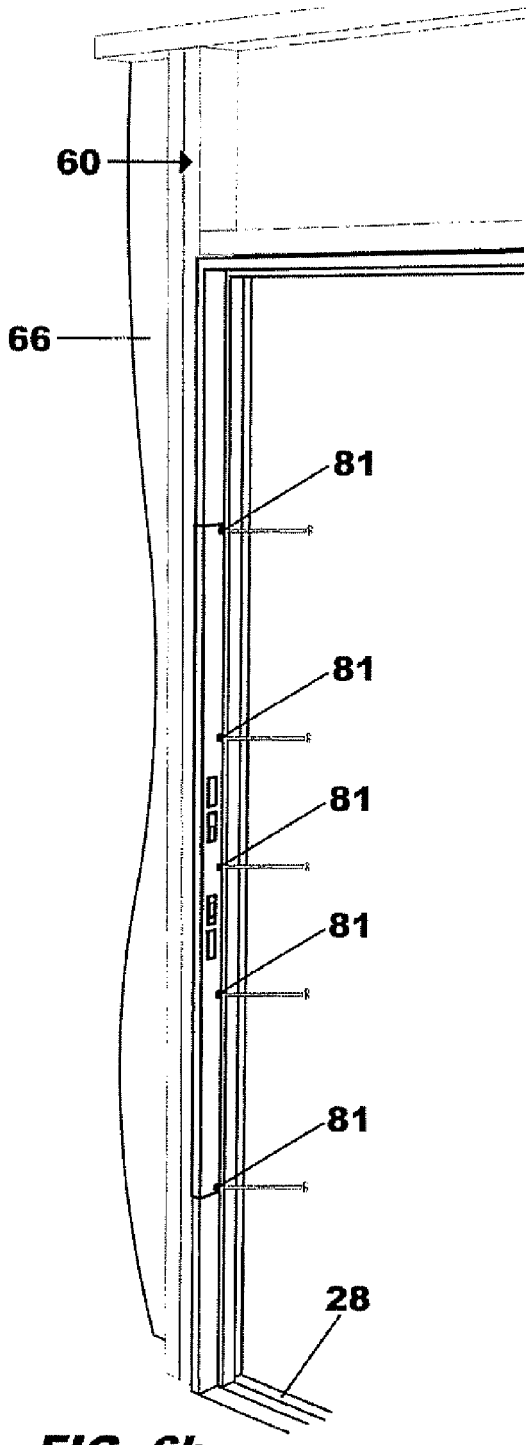
Figure 7B:
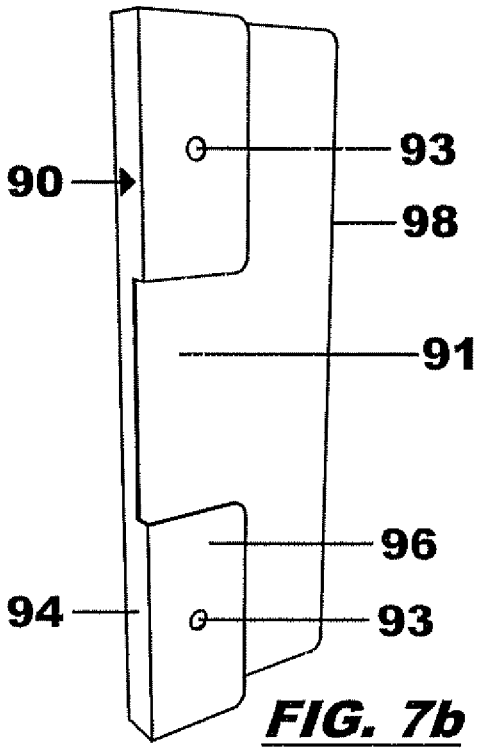
FIGS. 7*a-c* are front elevation, perspective and top views of a door jamb shield for use on the hinged door edge of an entry door assembly.
Figure 7C:
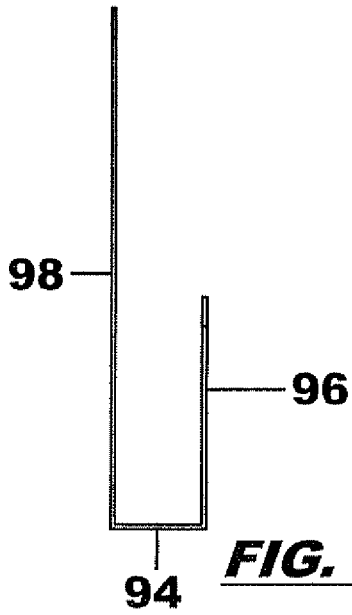
Figure 7A:
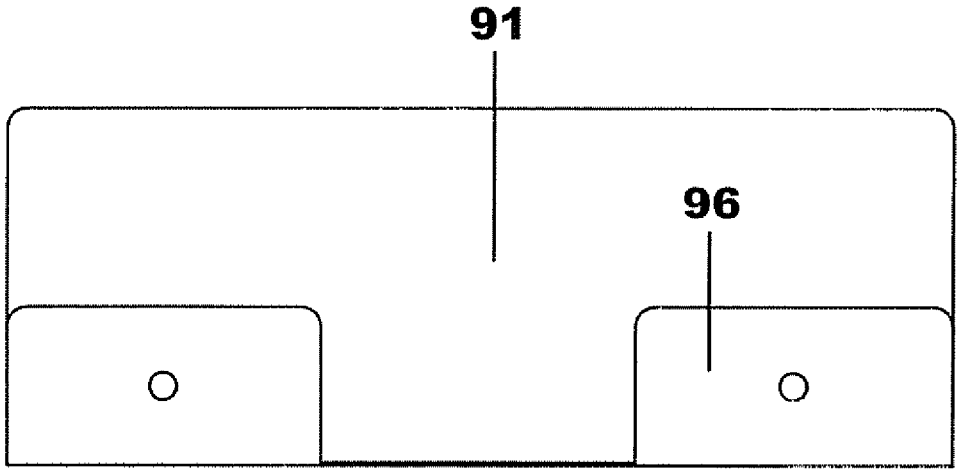
Figure 8B:
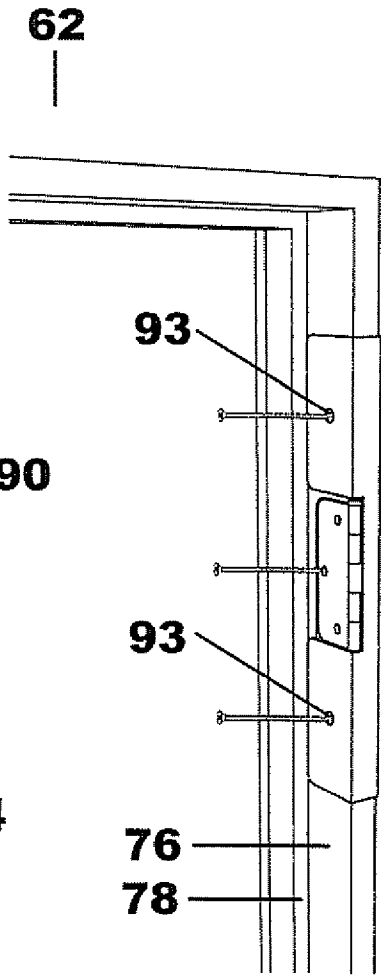
FIGS. 8*a* and 8*b* are perspective views of the portion of a door jamb and a door jamb shield corresponding to the hinged door edge of an entry door assembly.
Figure 8A:
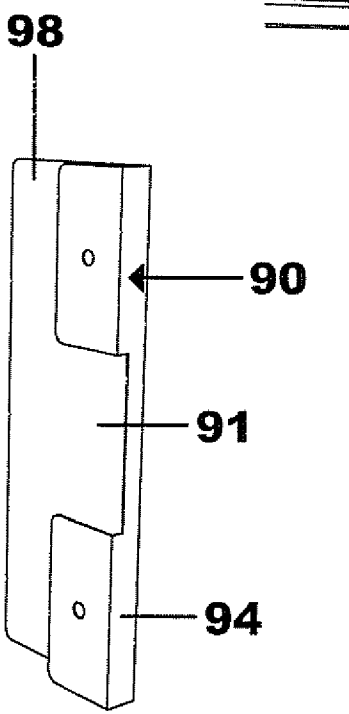
Figure 8A:
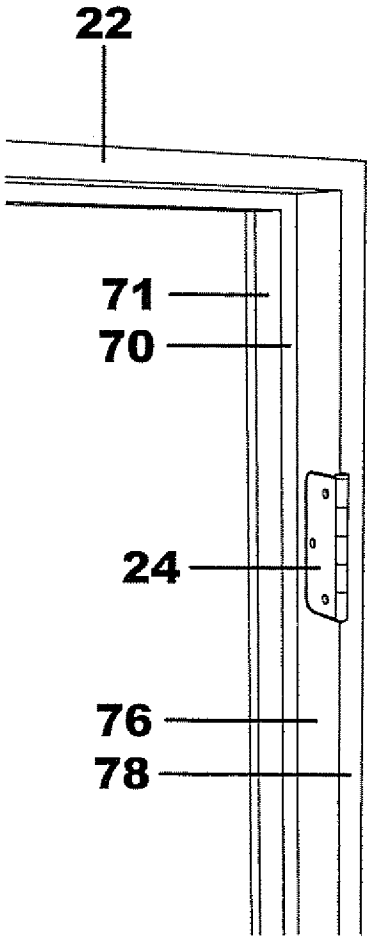
Figure 9A:
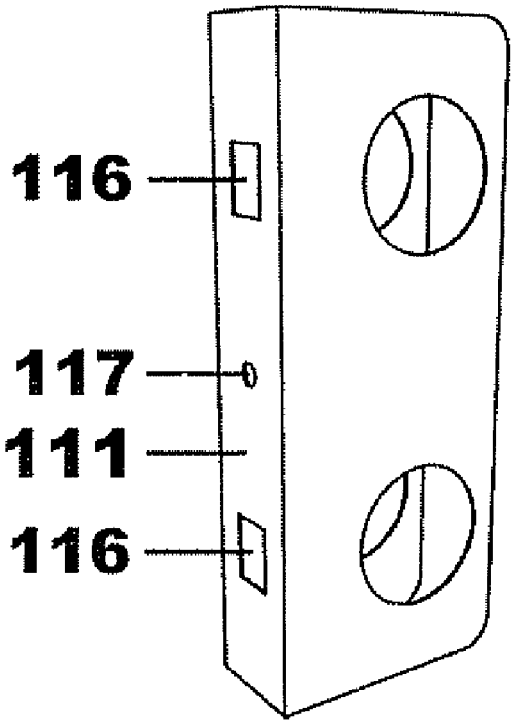
FIGS. 9*a-f* are front elevation, perspective and top views of alternative examples of a door slab reinforcement plate.
Figure 9B:
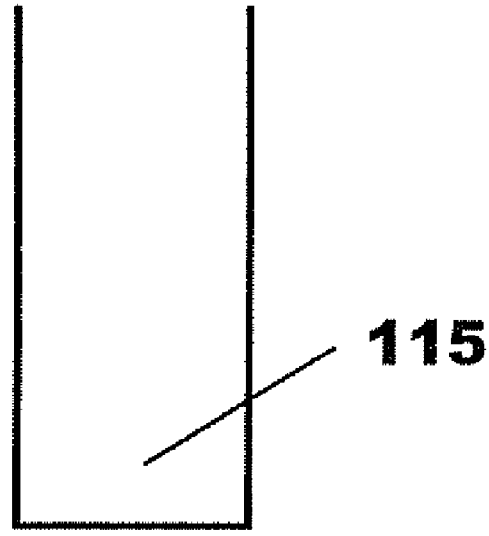
Figure 9C:
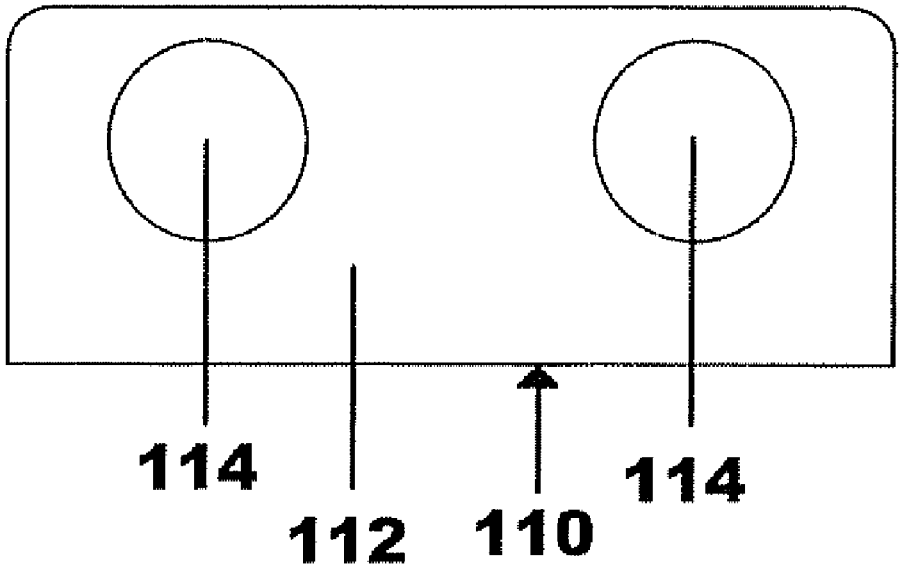
Figure 9D:
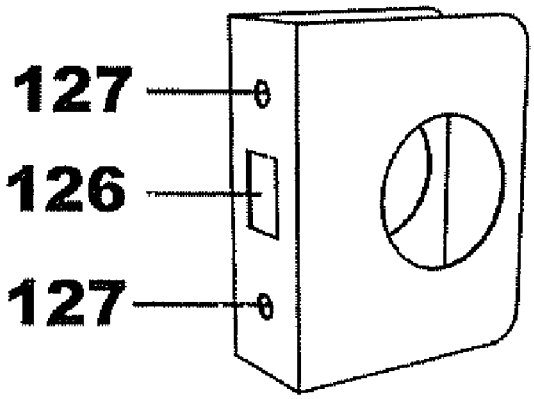
Figure 9E:
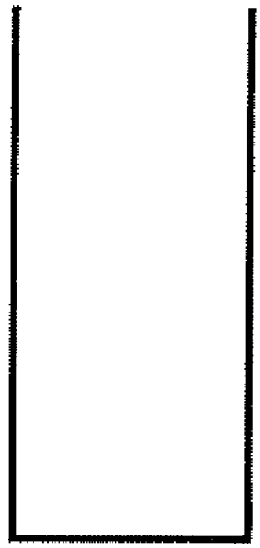
Figure 9F:
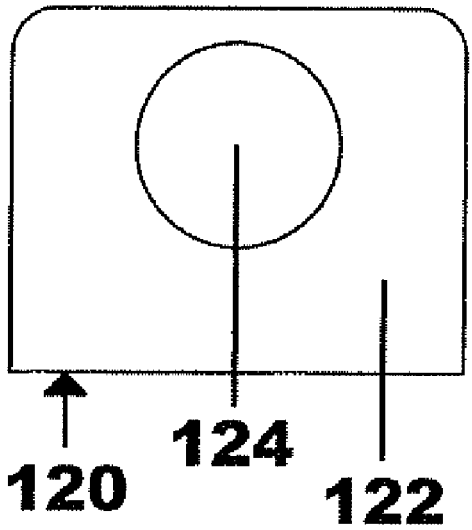
Figure 10A:
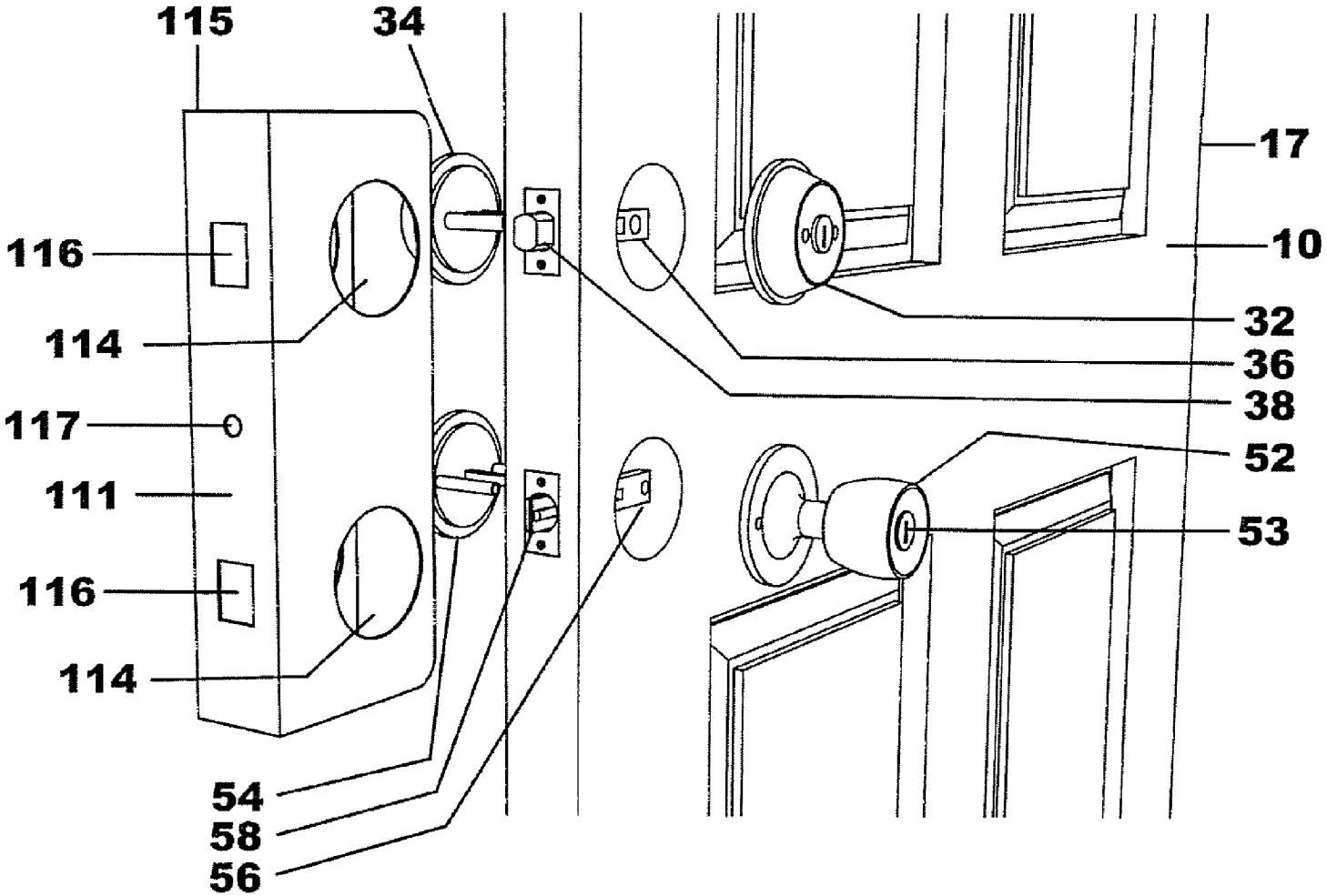
FIGS. 10*a* and 10*b* are perspective views of a door slab and door slab shield.
Figure 10B:
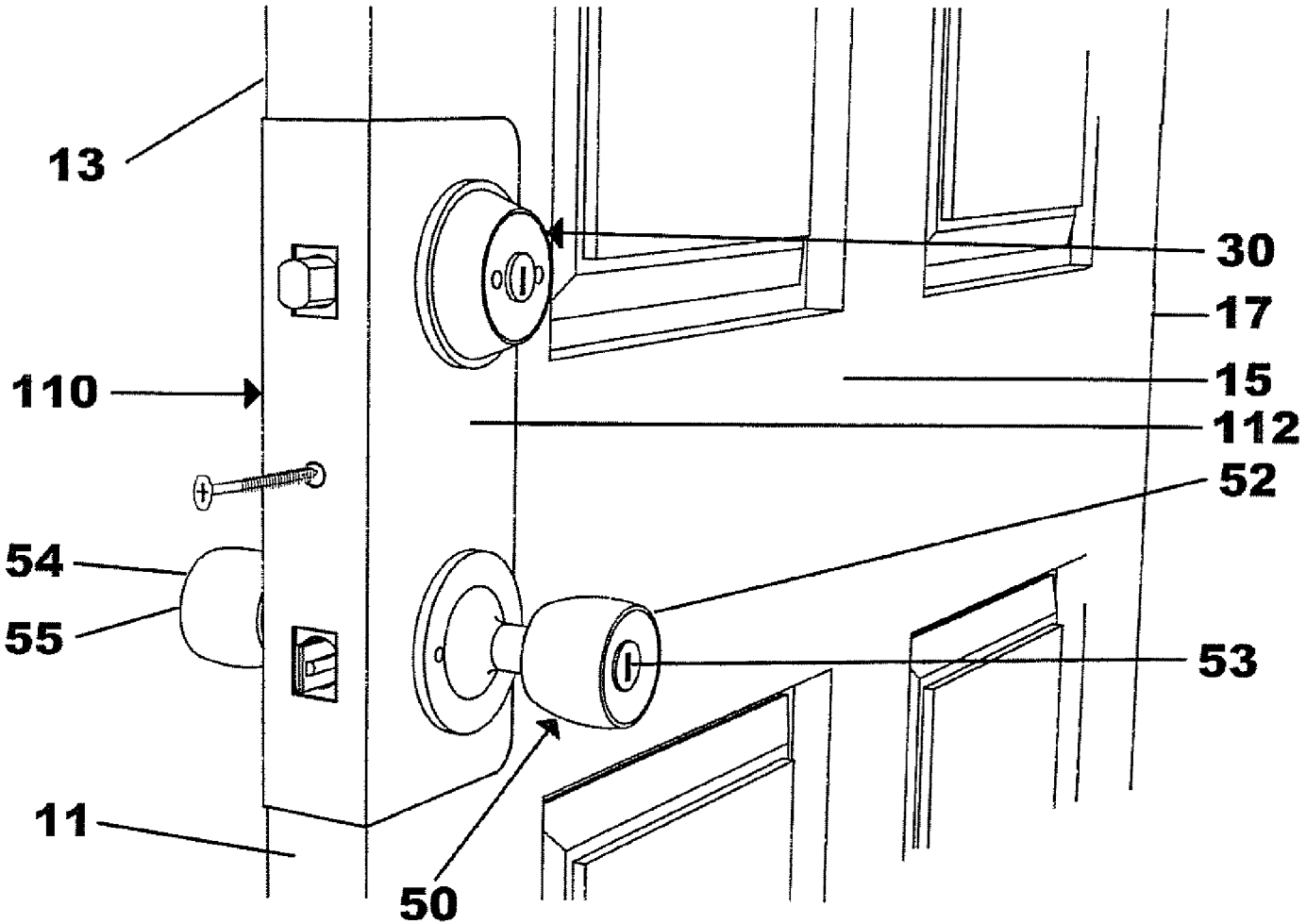
Figure 11A:
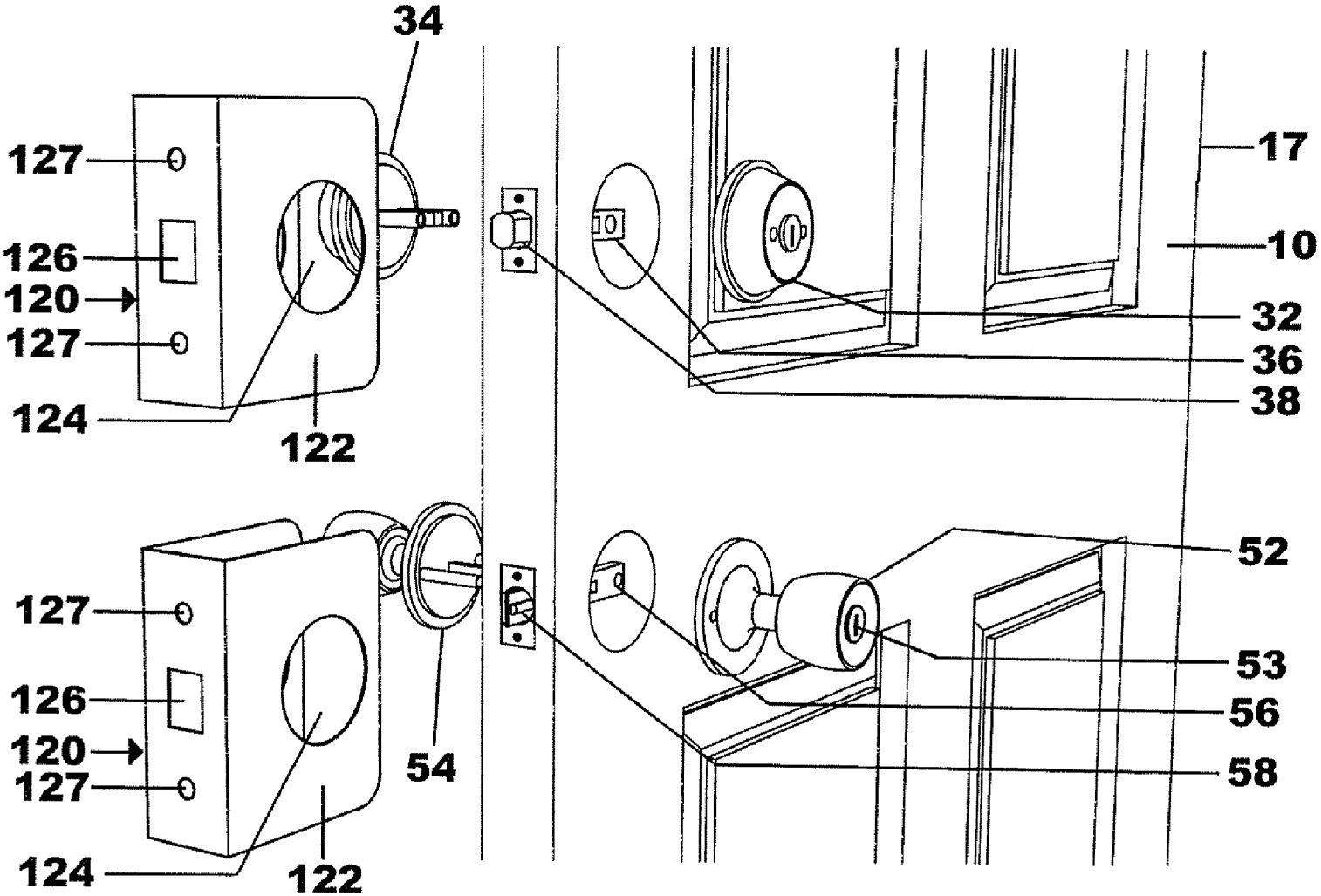
FIGS. 11*a* and 11*b* are perspective views of a door slab and door slab shield.
Figure 11B:
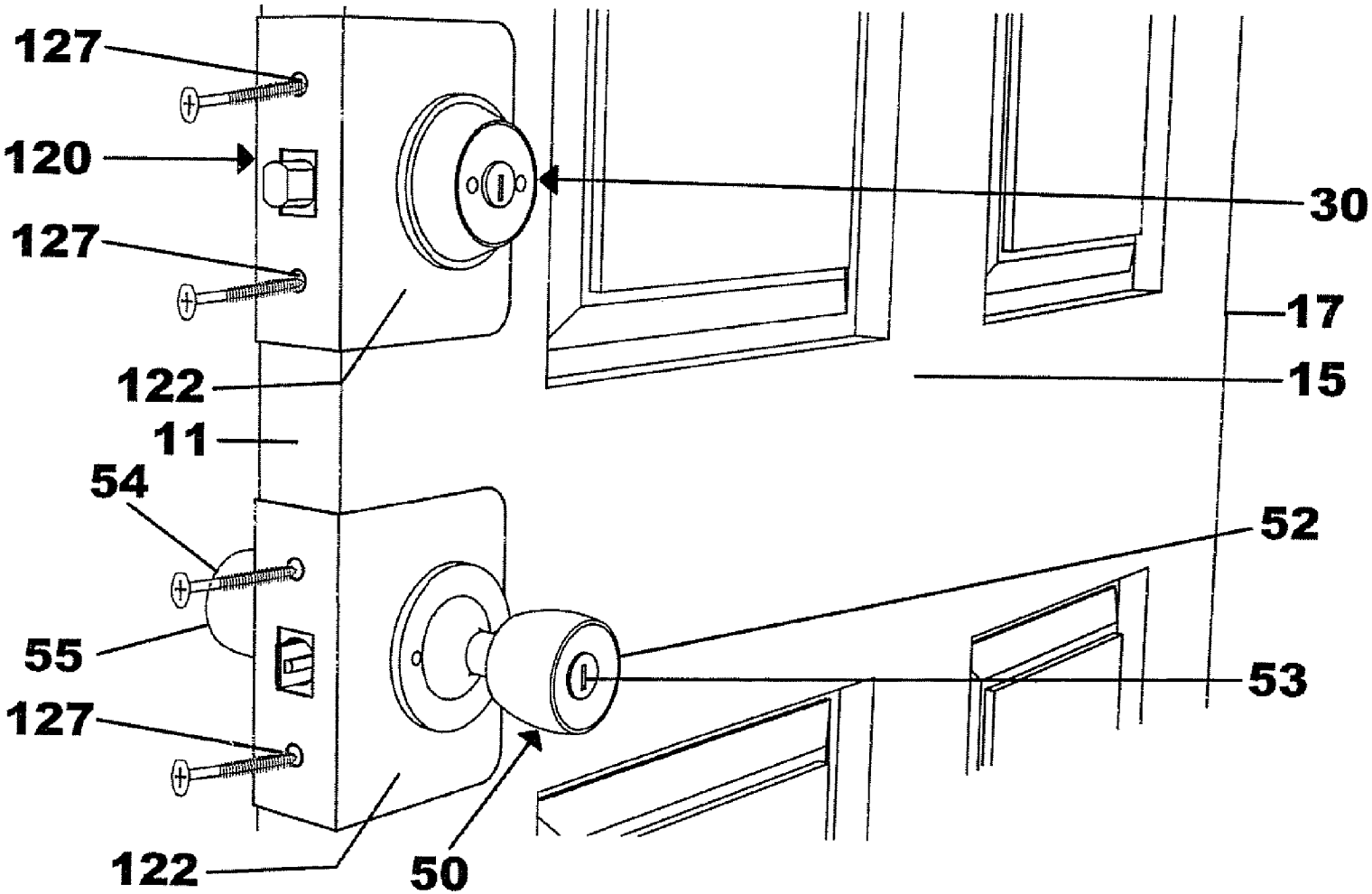

The present invention described and further detailed herein is particularly useful as a security device for the reinforcement of new door assemblies and equally suited for the repair of entry door assemblies while the assembly remains in place. In place refers to the door assembly as mounted in an existing structure with means having been taken to ensure fixation to the structure in the current location. Accordingly a door assembly, as shown in FIGS. 1*a-c* and FIG. 2, shall be an assembly including a door slab (10) that is hinged (24) along one vertically elongated edge then fixed to the door jamb along a vertical member (12) allowing the door slab to swing and thus accommodate opening and closure. As well the door slab (10) shall have locking hardware (30)(50) mounted on the opposite vertical free swinging edge (11) so that this hardware may interface closely with the adjacent vertical door jamb member (12) upon door closure and lock actuation. Lock hardware shall typically involve a dead bolt (30) that has the locking mechanism (32) (34) (52) (54), as seen in FIGS. 10*a* and *b* and 11*a* and *b,* mounted both on the interior (13) and exterior face (15) of the door and is manually manipulated by a key to lawfully unlock the door from the exterior side. A knob or key may be used to control the operation of the dead bolt lock bolt (36) from the interior side to engage and disengage lock bolt plunger (38) from the receiving opening. FIGS. 5*a* and *b,* (72) of the door jamb (14). The lock bolt assembly (36) will extend perpendicularly, internal to the door slab, from the union of locking mechanisms (32)(34) on the door slab facing to the free swinging edge (11) where it is typically secured. A similarly arranged and actuated latch bolt assembly (50) shall be positioned some distance below the dead bolt (30) allowing the bolt plunger (58), of the latch bolt (56), to catch and remain engaged in the receiving opening (74) of the corresponding vertical door jamb member, while the door is closed. The bolt plunger (58) of the latch bolt (56) can be retracted by manipulation of the door knobs (52)(54) that will be positioned on the interior and exterior faces of the door (13) (15), according to typical placement. The latch bolt locking assembly (50) is typically designed to accept a key, for lawful entry, in the exterior locking mechanism (53) positioned in the center in the door knob. The interior door knob (54) will be assembled with a manually operated knob (55), centrally located, that can be fingered to lock and unlock the latch bolt; thereby allowing for turning of the door knobs (52) (54) to disengage the latch bolt plunger (58) from the corresponding strike plate (26) and receiving (74) opening in the door jab member (14).

A door jamb also commonly known as the finished frame shall be ordinarily comprised of opposing vertical jamb members (12)(14) that will be joined together by upper and lower common horizontal jamb members (22) (28). Each jamb member on its facing surface will include an offset surface (70) along its length which will cause the member to recess and have two distinct planes along the facing surface (71) into which a weather barrier is mounted The offset surface (70) shall serve as a sealing surface for the exterior door slab face (15) as well it will be a stop for the free swinging edge (11), in the closed position. The vertical and upper jamb members (12)(14) are typically of wooden composition, while the lower member (28) may be similarly created or of variable materials more resistant to weather related long term damage.

A pair of wooden vertical stud members (60) shall be immediately adjacent and parallel to the vertical jamb members (12) (14), separated only by positioning shims (64). These studs (60) will be interposed by the walls of the structure (66) and joined together above and below the door jamb by a common header (62) and common floor (68) respectively to form the rough frame (60) (62) (68). The door assembly detail in FIG. 2 including the door jamb (12)(14)(22)(28) is securely affixed in the rough frame (60) (62)(68), positioned true with shims (64) to ensure proper alignment and secured with suitable attaching hardware. Decorative molding (67) shall conceal the area immediately around the doorjamb (12) (14)(22)(28) on the inner, outer walls (60) and extends along floor (68) of the structure.

Subsequently the door slab (10), on the affixed edge (17), is attached to the door jamb with common hinge assemblies (24) secured by relatively short screws that are ordinarily set in the thin soft wood substrate of the door jamb. Accordingly the plunger portion of both lock bolts (38)(58) pass through a strike plate (26) of conventional construction and similarly mounted. Then engage the opposing vertical door jamb member (14) adjacent the door slab free swinging edge (11) and engaging the bolt receiving openings (72) (74), very near its interior edge (12). Typically the bolt plunger of the dead bolt (38) will penetrate more deeply into the door jamb than the bolt plunger of the latch bolt (58) and consequently requires the receiving opening to be suitably sized.

As a means for providing a door assembly security device that secures, reinforces and repairs a door assembly. The preferred embodiment of FIG. 2 will demonstrate a security system including door jamb and door slab improvement shields suitably situated on a door assembly. The attached figures are examples of the mounting components in accordance with the current invention.

As seen in FIGS. 3*a-c* and FIGS. 5*a* and *b,* the jamb shield component is a metal elongated sleeve shaped in a manner so as to generally present a J shaped cross section; thereby allowing it to extend, in close proximity, along the offset plane (76) of the door jambs facing surface (71) on the free swinging side of the door (11) assembly. The shield is then contoured to advance perpendicular and immediately abutted to the complete interior edge of the door jamb (78), before again bending perpendicular to be positioned along the entire posterior width of the vertical doorjamb member adjacent the free swinging edge of the door slab (14). The component will have multiple countersunk openings (81) along the facing surface of the first panel (87) into which the mounting hardware (100) is secured. As well there will be two identically sized openings centered and aligned vertically along the length of the same facing surface (82) (83), that will directly coincide with the lock bolt plunger receiving openings (72) (74) of the corresponding vertical door jamb member (14). The jamb shielding component (80) will be incorporated onto the door jamb in the area of the narrowed offset plane (76) specific to the region where the strike plates (26) are typically mounted around the lock bolt plunger receiving holes. The component will be arranged such that the common center section (86) of the elongated metal sleeve (80) created by the fore mentioned coinciding perpendicular bends of the sleeve will be facing the interior edge of the vertical door jamb member (12) (14) previously detailed. The first panel (87) of the metal sleeve will extend onto the offset plane (76) of the vertical door jamb member facing surface (71) with its extreme edge coming to rest flush against the offset surface (71) and behind the weather sealing component while maintaining a close parallel orientation to the offset plane (76). The second panel (88) will extend along closely and be parallel to the entire width of the same vertical door jamb member's posterior region (14). The common center section (86) connects the first and second side panels so that they are substantially parallel to each other. The distance between the first and second side panels is substantially the same as the thickness of the door jamb. Accordingly when the jamb shielding component is arranged as previously mentioned the position is adjusted Such that the openings in the first panel (87) correspond, with specific alignment, to the bolt plunger receiving holes (72) (74) in the corresponding vertical door jamb member (14). When precisely positioned the component is secured with suitable mounting hardware. This mounting hardware will constitute screws (100) that are placed in the countersunk openings (81) along the facing surface of the jamb shielding component (80). After properly preparing the material immediately beneath the countersunk opening (81), by means of pre-drilling, the screws are received in the opening such that they pass through the jamb shield component (80), the door jamb member (14), the shim material (64) and extend substantially into the tough frame (60) of the structure. When sufficiently engaged the screws will come to rest in the countersunk opening (82) of the component and appear to be in the same plane. Where the jamb shield component extends along the posterior portion of the vertical jamb member (14) there will be no corresponding facing surface portion of the component and therefore no countersunk openings. In this region the pre-drilling will establish the opening into which the screws will be secured. Again these screws will come to rest against the vertical jamb member (71) and appear to be level when finally positioned.

Additional FIGS. 4*a-c* and FIGS. 6*a* and *b* refer to a variation of the door jamb shielding component. The sleeve will be similarly constructed and arranged with exception being taken in the area of the first panel (87) that is to be positioned immediately parallel and in close relation to the offset plane (76) of the vertical door jamb member (14) immediately adjacent the door slab free swinging edge (11). The variable sleeve (80), will draw particular attention to the openings (83) (85) in sleeve that directly correspond with specific alignment to the lock bolt plunger receiving openings (72) (74) in the vertical door jamb member (14). The openings in the first panel are situated to allow for adjusting the sleeve, when arranged as thusly noted for the preferred component, such that some portion of the newly described openings (83) (85) will specifically align with the lock bolt plunger receiving openings (72) (74) in the door jamb. This conformation will allow for substantial variations in the vertical spatial alignment of the dead and latch bolts (30) (50) mounted in the door slab (10) coinciding with the respective lock bolt plunger receiving openings (72) (74) in the vertical door jamb member (14). Alternative construction in this manner notably increases the occasion for lock spacing other than traditional to be accommodated and thus enable application of the present invention over a broader spectrum of opportunity.

The featured embodiment of FIGS. 7*a-c* and FIGS. 8*a* and *b* relate to a hinge side jamb shield that is an elongated steel sleeve shaped in a manner so as to generally present a J shaped cross section; thereby allowing it to extend, in close proximity, along the offset plane of the vertical door jambs facing surface on the fixed or hinge side (76) of the door assembly. The first panel will be formed with a substantially rectangular cutout (91) centrally located, to accommodate the fixed portion of the hinge (24), with equivalent sections of the second panel (96) above and below the opening. The shield is then contoured to advance perpendicular and immediately abutted to the complete interior edge of the door jamb (12), before again bending perpendicular to be positioned along the entire posterior width of the vertical door jamb member of the fixed side of the door assembly (12). A common center section (94) connects the first and second side panels (96) and (98) so that they are substantially parallel to each other. The distance between the first and second side panels is substantially the same as the thickness of the door jamb. The component will have multiple countersunk openings (93) along the first panel (96) into which the mounting hardware is secured. The hinge side jamb shielding component will be incorporated onto the doorjamb in the area of the narrowed offset plane (76) specific to the region where the hinge assemblies (24) are typically mounted to the fixed side door jamb member (12). The component will be arranged such that the open section of the elongated metal sleeve created by the fore mentioned coinciding perpendicular bends of the sleeve will be facing the interior edge of the vertical door jamb member (12) previously detailed. The slight panel (96) of the sleeve will be constructed with an opening (91) along the facing surface large enough to accommodate hinge portion (24) previously mounted, in typical fashion, the vertical jamb member (12). The first panel of the metal sleeve (96) will extend onto the offset plane of the vertical door jamb member (12) facing surface (76) with its opening (91) centering on the hinge fixture (24). While positioned thusly the extreme edges of the equivalent upper and lower sections (96) will come to rest flush against the offset surface (70) and behind the weather sealing component while maintaining a close parallel orientation to the offset plane (76). The second panel (98) will extend along closely and be parallel to the entire width of posterior region of the same vertical door jamb member (12). When precisely positioned the component is secured with suitable mounting hardware in similar fashion as previously detailed.

As represented in FIGS. 9*a-f* and FIGS. 10*a* and *b* and 11*a* and *b* the door shielding component of the preferred invention is an elongated steel sleeve that is shaped in a manner to have a common center section closely abutted to the free swinging edge of the door slab (11). The sleeve will be constructed with openings in this portion that are positioned to coincide with specific alignment and accommodate the lock bolt plunger (38) (58) operation as it is manipulated to extend and retract from the door slab edge (11) while respectively engaging and disengaging the corresponding vertical jamb member (14). The door shield component is further contoured to have perpendicular side panels (112) paralleling and in close proximity to the large facing surfaces of the door slab (13) (15). The panel (111) have openings (116) of sufficiently sized for installation of typical locking devices (30) (50) as previously detailed. The component will be arranged such that the open section of the elongated metal sleeve (115) created by the fore mentioned coinciding perpendicular bends of the sleeve will be immediately against the free swinging edge of the door slab (11). In this position the openings (116) in this portion that are will coincide with specific alignment of the lock bolt plungers (38) (58). Thereby permitting it to be manipulated to extend and retract from the door slab edge (11) while respectively engaging and disengaging the corresponding vertical jamb member (14). Resulting in the side panels (112) extending, snugly against the interior and exterior facing surfaces (13) (15), towards the fixed edge of the door slab (17).

FIGS. 9*a-c* and FIGS. 9*d-f* show alternate examples of the door shield component. Basically the major variation being represented in these drawing details a separation of the component into two parts. This configuration allows the two part sleeve to be adjusted for substantial variations in the vertical spatial alignment of the dead and latch bolts mounted in the door slab coinciding with the respective lock bolt plunger receiving openings in the vertical door jamb member. Alternative construction in this manner permits use of the door shield component in cooperation with the alternate embodiment of the jamb shield component.

In use, the present system of invention can be characterized by its multi-functionality, ease of installation, adaptability, superior design and simplicity. Briefly the steps for installation follow: Remove interior trim modeling and strike plates (67)(26). Position the jamb shield component (80). Form holes in the corresponding door jamb for reception of screws (82). Secure the jamb shield in place with suitable screws (100). Position the hinge side jamb shield component (90) ensuring the line up with the lock bolt plungers openings (72) (74). Form holes in the corresponding door jamb (12), as detailed, for the reception of screws. Secure the hinge side jamb shield in place as detailed with suitable screws. Remove the locking devices (30) (50) from the door slab surfaces (13) (15). Position the door shield component on the door slab free swinging edge so as to allow the lock bolt plungers (38) (58) to pass through the corresponding openings in it (116). Secure the component in place with suitable screws and re-install the locking devices (30) (50) over the door shield component side panels (112), securing it in place.

The different shield components described herein are made of steel for strength reasons. Other metals or strong materials may alternatively be used to form the shields. Also, the actual dimensions of the various shield components may vary. The door jamb shield sleeve used for the door slab free swinging edge is from about six inches to about eight feet long, or alternatively about two feet to six feet long, or in one example about 48 inches long. The corresponding side panels have widths of from about a half inch to about six inches. In one example, one side panel is about two inches wide, and the second side panel is about four inches wide. For a door jamb shield sleeve used on the door hinge side of the jamb, the sleeve is about four inches to three feet long, and in one example about one foot long. The side panels may have widths of from about a half inch to about six inches. In one example, one side panel is about two inches wide, and the second side panel is about four inches wide. The size and shape of the cutout is designed to correspond to the dimensions of a hinge plate which is typically rectangular.

In applications involving repair of a door assembly, using the present invention, as much the remaining door jamb member or door slab material as possible should be positioned to accept the appropriate components. When these door assemblies are severely damaged additional alignment maybe necessary to properly install the present system.

When the components of the present door security system are deployed alone or in combination as previously detailed they form a cohesive system that improves the security offered by a door assembly, reinforces and retrofits existing doors assemblies and repairs damaged assemblies. These means are achieved by the components wrapping key elements of a door assembly in metal and securing them to the surrounding structure. The wrapping design reinforces these elements by placing metal along three sides of each piece and particularly along the typical load bearing surfaces exposed to a forced entry attempt, thereby preventing the splintering of the door assembly. The repair function allows for the door assembly elements to be easily repaired by sliding the door security components into place thereby wrapping the previously damaged areas. This will also serve to conceal the prior damage. On a typical door assembly this means the door jamb member corresponding to the free swinging, hinge side door jamb member and door slab are wrapped in steel, while remaining in place, to repair or prevent further damage when substantial force is applied.

Having thus described and detailed the present invention, it is to be understood that many obvious and apparent variations in construction and arrangement may be made without departing from the overall scope and spirit thereof as defined by the appended claims. Furthermore, it is intended that the foregoing specifications and accompanying drawings be interpreted as illustrative rather than in a limiting sense.

What is claimed is:

1. A door jamb shield mounted around a wooden door jamb, the shield comprising:

at least two elongated, single piece, metal sleeves having a J-shaped cross section;

each sleeve comprising first and second side panels and a common center section that connects the first and second side panels, wherein the first and second side panels are substantially parallel to each other;

wherein the wooden door jamb has a thickness and the distance between the first and second side panels is predetermined to be substantially the same as the thickness of the wooden door jamb;

wherein the sleeves are mounted at least one on the free swinging side of the door assembly and a second on the hinge side of the door assembly;

wherein the second sleeve mounted on the hinge side comprises a substantially rectangular cutout on one of the side panels, the cutout sized to correspond to the size of a door hinge plate;

whereby the sleeves are adapted to be positioned around and receive portions of the door jamb between the side panels of the sleeves.

2. The door jamb shield described in claim 1, wherein the first side panel or the second side panel of one of the metal sleeves comprises a countersunk opening adapted to receive a door dead bolt or a door bolt plunger.

3. The door jamb shield described in claim 2, wherein one of the metal sleeves comprises a plurality of countersunk openings adapted to receive a door dead bolt or door bolt plunger.

4. The door jamb shield described in claim 1, wherein one of the sleeves has a length of at least 48 inches.

5. The door jamb shield described in claim 1, wherein the first side panels have a width of about two inches, and the second side panels have a width of about four inches.

6. The door jamb shield described in claim 1, wherein the metal sleeves are comprised of steel having a thickness in the range of about 16 to 24 gauge.

7. A door jamb shield mounted around a wooden door jamb, the shield comprising:

an elongated, single piece, metal sleeve having a J-shaped cross section; the sleeve comprising first and second side panels and a common center section that connects the first and second side panels, wherein the first and second side panels are substantially parallel to each other;

wherein the second side panel has a greater width than the first side panel, and the first side panel comprises a substantially rectangular cutout therein;

wherein the wooden door jamb has a thickness and the distance between the first and second side panels is predetermined to be substantially the same as the thickness of the wooden door jamb;

wherein the substantially rectangular cutout is sized to correspond to the size of a door hinge plate;

whereby the sleeve is positioned around and receives a portion of the door jamb between the side panels of the sleeve on the hinge side of the door jamb.

8. The door jamb shield described in claim 7, wherein the substantially rectangular cutout is sized to correspond to the size of a door hinge plate.

9. The door jamb shield described in claim 7, wherein the sleeve has a length of at least one foot.

10. The door jamb shield described in claim 7, wherein the first side panel has a width of about two inches, and the second side panel has a width of about four inches.

11. The door jamb shield described in claim 7, wherein the metal sleeve is comprised of steel having a thickness in the range of about 16 to 24 gauge.

12. A method of reinforcing a wooden door jamb mounted within a rough frame, the method comprising:

providing a door jamb shield comprising:

an enlongated, single piece, metal sleeve having a J-shaped cross section;

the sleeve comprising first and second side panels and a common center section that connects the first and second side panels, wherein the first and second side panels are substantially parallel to each other, and wherein the sleeve has a length of at least about one foot;

wherein the first side panel comprises a substantially rectangular cutout therein, the cutout sized to correspond to the size of a door hinge plate;

wherein the door jamb has a thickness and the distance between the first and second side panels is predetermined to be substantially the same as the thickness of the door jamb;

mounting the door jamb shield around the door jamb; providing fasteners having a length in excess of the width of the center section of the door jamb shield;

fastening the door jamb shield to the door jamb and to the rough frame using fasteners.

* * * * *